United States Patent [19]

Tanabe et al.

[11] Patent Number: 4,584,981

[45] Date of Patent: Apr. 29, 1986

[54] INTAKE SYSTEM FOR INTERNAL COMBUSTION ENGINE

[75] Inventors: Yoshiyuki Tanabe; Mineo Kashiwaya; Kiyomi Morita; Katsunobu Kameta, all of Katsuta, Japan

[73] Assignee: Hitachi, Ltd., Tokyo, Japan

[21] Appl. No.: 658,024

[22] Filed: Oct. 5, 1984

[30] Foreign Application Priority Data

Oct. 7, 1983 [JP] Japan ..... 58-187043

[51] Int. Cl.[4] ..... F02B 3/00

[52] U.S. Cl. ..... 123/472; 123/585; 123/586; 261/41 D; 261/DIG. 82

[58] Field of Search ..... 123/472, 478, 585, 586, 123/587; 261/41 C, 41 D, 63, DIG. 1, DIG. 39, DIG. 74, DIG. 82

[56] References Cited

U.S. PATENT DOCUMENTS

| | | | |
|---|---|---|---|
| 2,487,774 | 11/1949 | Schipper | 123/472 |
| 4,335,689 | 6/1982 | Abe | 123/399 |
| 4,359,983 | 11/1982 | Carlson | 123/585 |
| 4,416,241 | 11/1983 | Knapp | 123/585 |

OTHER PUBLICATIONS

Buick Chassis Service Manual, 1984, General Motors Corp.

*Primary Examiner*—Ronald B. Cox

*Attorney, Agent, or Firm*—Antonelli, Terry & Wands

[57] ABSTRACT

An intake system for an internal combustion engine has a fuel injector disposed in an induction passage upstream of a pivotally mounted throttle plate having an idle position in which the throttle plate has upstream and downstream edge portions slightly spaced from the inner peripheral surface of the induction passage to define therewith narrow gaps for the passage of air and injected fuel particles. A bypass air passage is formed in the peripheral wall of the induction passage and has a downstream end open thereto to produce a jet of air directed toward the central zone of the downstream face of the throttle plate when in the idle position. The air jet is operative to compensate for the difference in pressure between a central space immediately downstream of the throttle plate and peripheral zones adjacent to the narrow gaps whereby whirling-up of air and fuel particles just downstream of the throttle plate and resultant formation of drops of liquid fuel can be prevented.

2 Claims, 6 Drawing Figures

INTAKE SYSTEM FOR INTERNAL COMBUSTION ENGINE

BACKGROUND OF THE INVENTION

The present invention relates to an intake system for internal combustion engines and, more particularly, to an engine intake system employing a single or a plurality of fuel injectors disposed in an induction passage, upstream of a throttle valve to inject jets of fuel into the induction passage.

In, for example, Japanese pre-examination patent publication No. 79666/83, an intake system for an internal combustion engine is proposed which includes a single or plurality of fuel injectors for injecting jets of fuel into an inducation passage upstream of a throttle valve disposed therein. The throttle valve is rotatable about the axis of a throttle shaft between idle and fully opened positions. When the engine is in an idle operation, the throttle valve is inclined to the axis of the induction passage and has upstream and downstream edge portions slightly spaced from the inner peripheral surface of the induction passage to cooperate therewith to define narrow gaps through which air and the injected fuel particles are allowed to pass toward engine cylinders. A part of the air and fuel particles then whorls toward the center of the underside of the throttle valve due to vacuum immediately downstream of the throttle valve whereby vortices are generated downstream of the throttle valve. The fuel particles suspended in the whirling air streams tend to gather at a central zone of the vortices to form a mass of liquid fuel. When the liquid mass has grown to a certain size, a part of the liquid mass is separated therefrom to form drops which are sucked into the engine. For this reason, the fuel is not fed into the engine at a uniform rate during an entire idle operation, resulting in an unstable engine idle operations and difficulties in the emission control as will be discussed more fully hereinbelow.

SUMMARY OF THE INVENTION

The object of the present invention resides in providing an improved intake system for an internal combustion engine which assures a stable engine idle operation.

In accordance with the present invention, an engine is provided which includes a means for defining an induction passage, a throttle valve disposed in the induction passage, and at least one injector disposed in the induction passage upstream of the throttle valve and so arranged so as to inject a jet of fuel therein. The throttle valve is movable between an idle position and a wide open position and, when in the idle position, the throttle valve has an edge portion slightly spaced from an inner peripheral surface of the induction passage so as to define therewith a narrow gap for passage of air and fuel for an engine idle operation. Additionally, means are provided for defining an air passage extending in a bypassing relationship to the narrow gap and terminating in a downstream air outlet and arranged to direct a jet of bypassing air substantially toward a central space immediately downstream of the throttle valve when the throttle valve is in the idle position.

DETAILED DESCRIPTION

Figure 1:
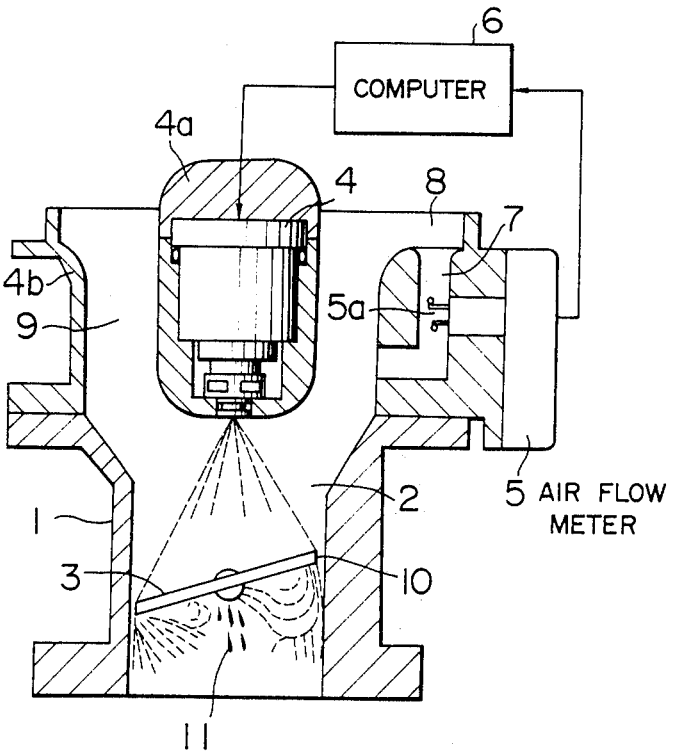
FIG. 1 PRIOR ART
FIG. 1 is an axial sectional view of the prior art intake system.

Referring now to the drawings wherein like reference numerals are used throughout the various views to designate like parts and, more particularly, to FIG. 1, according to this figure, a prior art one point intake system includes a throttle valve 3 formed by a circular throttle plate mounted on a rotatable throttle shaft 3*a* extending diametrically through an induction passage 2 a portion of which is defined in a throttle body 1. A fuel injector 4 is supported by a holder 4*a* disposed centrally of a venturi chamber 4*b* to cooperate therewith to define an annular venturi which forms a part of the induction passage 2. A bypass air passage 7 is formed in the peripheral wall of the venturi chamber 4*b* and has an upstream end opened to a part 8 of the induction passage disposed upstream of the venturi 9. The downstream end of the bypass air passage 7 is open to the venturi 9.

A conventional electric air flow meter 5 is attached to the outer peripheral surface of the venturi chamber 4*b* and includes a hot-wire type air flow sensor or temperature-sensitive resistor 5*a* disposed in the bypass air passage 7 to meter the flow of the air therethrough and thus to determine the total air flow through the induction passage into an associated engine (not shown). The air flow meter 5 produces an electric signal representive of the rate of air flow into the engine and emits the signal to a computer 6, which is operative in response to the input signal, to compute the rate of fuel supply optimum to the rate of air supply to the engine for thereby emitting fuel supply signals to the injector 4. The injector 4 is responsive to the fuel supply signals from the computer 6 to inject jets of liquid fuel into the induction passage 2 so that the engine is supplied with a mixture of air and fuel at an air/fuel ratio most suited to the engine operation.

In the intake system of the type described hereinabove, when a throttle plate 3 is in the idle position shown in FIG. 1, the air and fuel particles passing through narrow gaps 10, defined between the upper or upstream and lower or downstream edge portions of the throttle plate 3 are whirled toward the central zone of the induction passage 2 immediately below the throttle shaft and downstream of the throttle plate 3 as schematically illustrated in FIG. 1. This arises due to a difference in pressure between the sections of the induction passage 2 adjacent to the narrow gaps 10 and the central section of the induction passage just downstream of the throttle plate 3. The whirled air streams and fuel particles are gathered to a central space of the induction passage just downstream of the throttle valve 3. The fuel particles thus gathered form a mass of liquid fluid and, when the liquid mass has grown to a certain size, a part of the liquid fuel is separated from the mass to form drops 11 which are then fed into the engine. The formation of the liquid mass is quite undesirable to engine idle operations because the addition of the fuel drops 11 to continuous supply of normal air-fuel mixture to the engine is discontinuous and causes a non-uniform rate of fuel supply during an engine idle operation thereby resulting in an unstable idle operation of the engine. Additionally, by virtue of the introduction of the liquid fuel drops into the engine, the CO and HC contents of the engine exhaust gases are increased.

Figure 2:
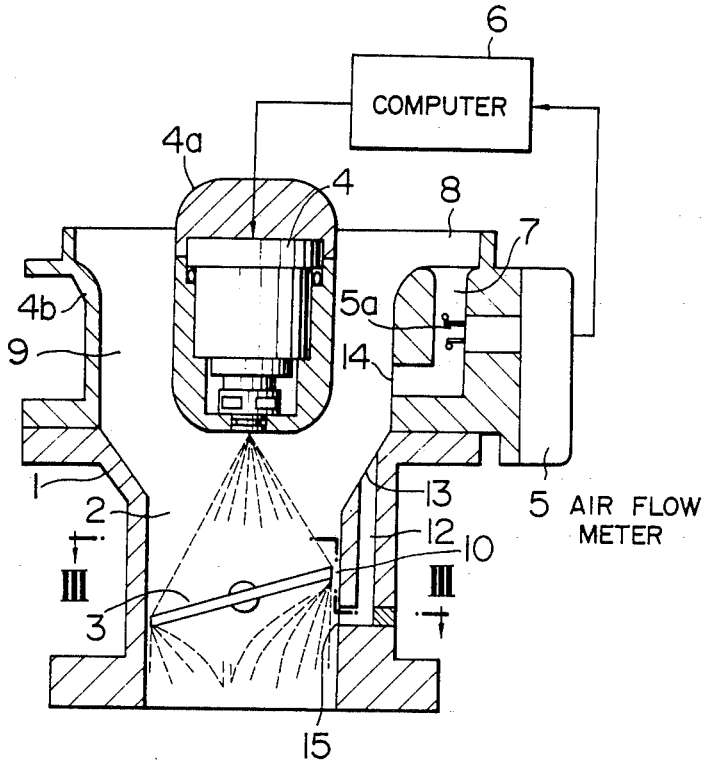
FIG. 2 is an axial cross-sectional view of an embodiment of the intake system for an internal combustin engine according to the present invention.
Figure 3:
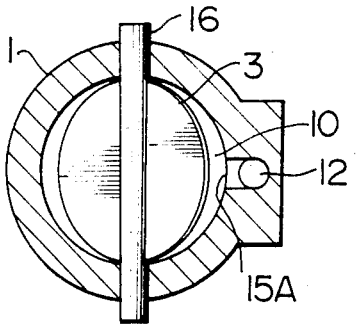
FIG. 3 is a cross-section taken along line III—III in FIG. 2.

To avoid the above and other problems encountered in the prior art, as shown in FIGS. 2–3, according to the present invention, an intake system for an internal combustion engine includes an air.

The improvement of the embodiment of the present invention shown in FIGS. 2 and 3 comprises an air passage 12 formed in the peripheral wall of the throttle body 1 and extends in bypassing relationship to the gap 10 defined between the inner peripheral surface of the throttle body 1 and the upward edge portion of the throttle valve 3 when it is in its idle position. The bypass air passage 12 has its upstream end 13 open to the induction passage 2 at a point disposed radially outwardly of the cone of the jet of fuel injected by the fuel injector 4. In the illustrated embodiment of the invention, the downstream end 15 of the bypass air passage 12 is open to the induction passage 2 at a point downstream of the upstream edge portion of the throttle valve 3 when in its idle position and directed substantially toward the central zone of the undersurface or downstream face of the throttle valve 3.

Thus, when the engine is in its idle operation, a part of the air which has passed through the venturi 9 enters the bypass air passage 12 and flows therethrough in bypassing relationship to the flow of air and fuel particles passing through the gap 10. The bypass air is then jetted through the downstream end 15 of the bypass air passage 12 into the induction passage 2 downstream of the throttle valve 3. The jet of air is directed substantially toward the central zone of the downstream face of the throttle valve 3 to eliminate or compensate for the difference in pressure between the induction passage 2 just downstream of the throttle valve 3 and the sections of the induction passage 2 adjacent to the gaps 10, which difference would otherwise be caused due to the reason discussed above in connection with the prior art. Accordingly, the air and fuel particles which have passed through the gaps 10 flow smoothly toward the engine and will not be whirled up to the center of the induction passage 2 immediately downstream of the throttle valve. For this reason, the production of a liquid mass and resultant formation of fuel drops, which takes place in the prior art, are advantageously avoided to assure a stable fuel supply to the engine at a substantially constant rate all over an engine idle operation for thereby insuring a stable engine idle operation and minimized emission of CO and HC.

It will be appreciated that, because the upstream end 13 of the bypass air passage 12 is disposed outwardly of the cone of the jet of fuel injected by the injector 4, the air flowing through the bypass air passage 12 and jetted through the downstream end 15 thereof does not contain any amount of fuel. Thus, the inner peripheral surface of the induction passage 2 downstream of the downstream end 15 of the bypass air passage 12 is prevented from being adhered by any liquid film or drops of the fuel which would oterwise flow through the bypass air passage 12. Such a liquid film or drops of fuel cannot easily be atomized and thus will adversely affect the engine operation and emission control.

In addition, the upstream end 13 of the bypass air passage 12 is located downstream of the downstream end 14 of the first bypass air passage 7 which contains the temperature-sensitive air flow sensor element 5a. Thus, the part of the air flow which passes through the second bypass air passage 12 is included in the total air flow to the engine which has already been measured by the air flow meter 5. This feature is advantageous in the view point of air-fuel ratio control.

The position of the downstream end 15 of the bypass air passage 12 is important to attain the intended purpose. In the embodiment of the invention shown in FIG. 2, the downstream end 15 is positioned at a level substantially the same as the level of the downstream edge portion of the throttle valve 3 when in its idle position. However, in the modification shown in FIG. 4, the downstream end 15 of the bypass air passage 12 is located immediately or slightly below the upstream edge portion of the throttle valve 3 when in the idle position. The bypass air passage downstream end 15, however, is not limited to the positions shown in FIGS. 2 and 4 and can be located at any point within the distance or range defined between the positions shown in FIGS. 2 and 4.

Figure 4:
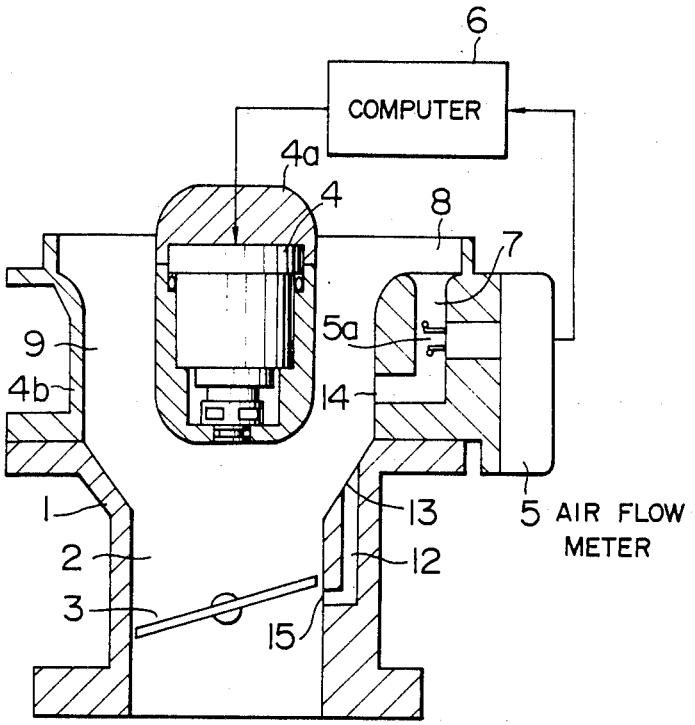
FIG. 4 is similar to FIG. 2 but illustrates a modification to the embodiment shown in FIG. 2.

Secondly, the bypass air passage downstream end 15 should be open in the induction passage 2 on the side thereof substantially aligned with the upstream edge portion of the throttle valve 3 as viewed in the flow of air through the induction passage 2, namely, on the righthand side of the induction passage 2 as viewed on the illustrations in FIGS. 2 and 4. If the downstream end 15 of the bypass air passage 12 were formed in the lefthand side of the induction passage 2, i.e., adjacent to the downstream edge portion of the throttle valve 3, the air jetted from such a downstream end will not be operative to prevent the downsteram face of the throttle valve 3 from being adhered by fuel particles.

Figure 5:
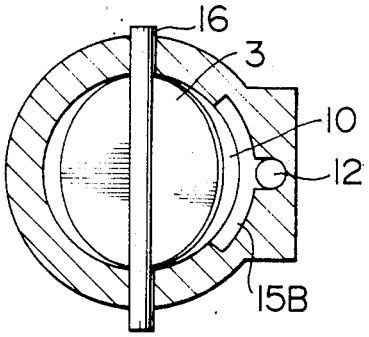
FIG. 5 shows a modification to the embodiment shown in FIG. 3.

In the embodiment of the invention shown in FIG. 2 and the modification shown in FIG. 4, the downstream end 15 of the bypass air passage 12 is in the form of a circular opening 15A, as shown in FIG. 3. In the modification shown in FIG. 5, however, the bypass air passage downstream end 15 is in the form of an arcuate slit or groove 15B formed in the inner peripheral surface of the throttle body 1 and extending circumferentially thereof over a predetermined angle. The opposite ends of the length of the groove 15B are shaped to direct air substantially toward the central area of the undersurface or downstream face of the throttle valve 3 when it is in its idle position.

When the throttle valve 3 is in a wide-open position, the pressure in the induction passage 2 downstream of the throttle valve is substantially equal to the pressure in the induction passage 2 upstream of the throttle valve 3. In such an engine operating condition, therefore, little air flows through the bypass air passage 12. Thus, the flow of air through the bypass air passage 12 takes place only when the pressure differential across the throttle valve 3 exceeds a predetermined level.

Figure 6:
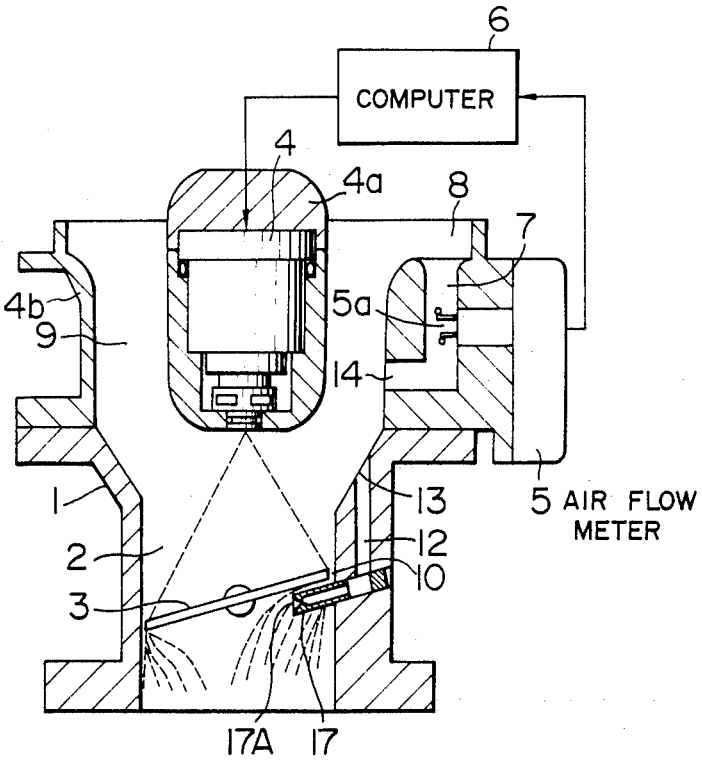
FIG. 6 is similar to FIGS. 2 and 4 but illustrates another embodiment of the invention.

In the second embodiment shown in FIG. 6 of the drawings, an air nozzle 17 is fitted into the downstream end of the bypass air passage 12 and extends inwardly from the inner peripheral surface of the throttle body 1 substantially toward the center of the bypass air passage 2. The air nozzle 17 is provided with nozzle orifice 17A adjacent to the inner end of the nozzle 17. The air entering the bypass air passage 12 is jetted through the nozzle orifice 17A to the central space of the induction passage just downstream of the throttle valve to reliably compensate for the diference in pressure between the central space of the induction passage immediately downstream of the throttle valve 3 and the peripheral zone of the induction passage 2 adjacent to the gaps 10, whereby the whirling-up of the air and fuel particles just downstream of the throttle valve is prevented. The nozzle orifice 17A adjacent to the inner end of the air nozzle 17 defines the narrowest section of the bypass air passage 12, so that the air is jetted through the nozzle orifice 17A substantially at sonic velocity. The sonic air jet, therefore, is operative to atomize the fuel particles in the induction passage just downstream of the throttle valve to thereby improve the stability of the engine idle operation.

As described above, the intake system according to the present invention is effective to prevent the formation of drops of fuel during engine idle operations for thereby ensuring smooth engine idle operations and reduced emission of CO and HC during engine idle operations.

What is claimed is:

1. An intake system for an internal combustion engine, the intake system comprising:

means for defining an induction passage;

a throttle valve comprising a throttle plate pivotally mounted in said induction passage by a throttle shaft extending substantially diametrically therethrough;

said induction passage defining means including a throttle body having said throttle valve mounted therein;

at least one fuel injector disposed in said induction passage upstream of said throttle valve and so arranged so as to inject a jet of fuel therein;

said throttle valve being rotatable about the axis of said throttle shaft between idle and fully-opened positions, said throttle valve when in said idle position being inclined to the axis of said induction passage and having upstream and downstream edge portions slightly spaced from the inner peripheral surface of said induction passage to cooperate therewith to define narrow gaps for the passage of air and fuel therethrough for an engine idle operation; and means for producing a jet of air directed toward the downstream face of said throttle valve when the intake vacuum downstream of said throttle valve exceeds a predetermined level, said air jet producing means including an air passage extending through said throttle body in bypassing relationship to said throttle valve and having an upstream end open to said induction pasage upstream of said throttle valve when in said idle position and disposed such that the fuel injected by said fuel injector does not enter said bypass air passage, said bypass air passage having a downstream end operative to direct a jet of air toward said downstream face of said throttle valve, said downstream end of said bypass air passage comprises an air nozzle extending radially inwardly of said induction passage substantially toward the central zone of said downstream end face of said throttle valve when in said idle position.

2. An intake system according to claim 1, wherein said nozzle has restricted nozzle orifice formed therein adjacent to an end thereof remote from the throttle body inner peripheral surface.

* * * * *